United States Patent [19]

Hill

[11] Patent Number: 5,020,423

[45] Date of Patent: Jun. 4, 1991

[54] ROTATING BLADE DAMPER WITH BLADE LOCK AND STOP MECHANISM

[75] Inventor: James R. Hill, Toledo, Ohio

[73] Assignee: Mestek, Inc., Westfield, Mass.

[21] Appl. No.: 556,122

[22] Filed: Jul. 20, 1990

[51] Int. Cl.[5] ..... F24F 11/00

[52] U.S. Cl. ..... 98/1; 49/7

[58] Field of Search ..... 98/1, 42.15; 49/1, 7; 126/287.5; 137/72, 74; 251/286

[56] References Cited

U.S. PATENT DOCUMENTS

| | | | |
|---|---|---|---|
| 2,287,262 | 6/1942 | Merry | 98/1 |
| 3,543,439 | 12/1970 | Pantland | 49/7 |
| 3,650,069 | 3/1972 | Alley | 49/7 |
| 4,080,978 | 3/1978 | McCabe | 137/79 |
| 4,081,173 | 3/1978 | McCabe | 251/308 |
| 4,113,230 | 9/1978 | McCabe | 251/305 |
| 4,184,288 | 1/1980 | Magill et al. | 49/7 |
| 4,338,967 | 7/1982 | McCabe | 137/601 |
| 4,442,862 | 4/1984 | McCabe | 137/601 |
| 4,487,214 | 12/1984 | Tatum | 137/72 |
| 4,555,981 | 12/1985 | McCabe | 98/1 |
| 4,581,987 | 4/1986 | Ulicny | 98/1 |
| 4,610,197 | 9/1986 | Van Becelaere | 98/110 |

*Primary Examiner*—Harold Joyce

*Attorney, Agent, or Firm*—Thomas A. Meehan

[57] ABSTRACT

A rotating blade damper for an air handling system, the damper having a perimetrical frame and a blade or a plurality of blades each of which is rotatable with respect to the frame between a flow permitting position and a flow blocking position. Each blade is biased toward its flow blocking position but is normally retained in its flow permitting position, for example, by a fusible link. A stop and lock mechanism is provided to stop each blade in a predetermined open or flow permitting position and to securely lock or latch each blade in its closed or flow blocking position. The stop and lock mechanism includes a disc segment which is carried by a blade rod, at a location outside of the damper frame, and a slide plate which is positioned between the damper frame and the disc segment. The slide plate is slidable with respect to the damper frame and the blade rod between a first position, corresponding to the open position of the blade, in which its movement is blocked by engagement with an arcuate portion of the disc segment, and a second position, corresponding to the closed position of the blade, in which it engages a stop surface at the trailing edge of the disc segment to mechanically block its return to a position corresponding to the open position of the blade.

42 Claims, 3 Drawing Sheets

ROTATING BLADE DAMPER WITH BLADE LOCK AND STOP MECHANISM

BACKGROUND OF THE INVENTION

1. Field of the Invention

This invention relates to a rotating blade damper for an air handling system. More particularly, this invention relates to a rotating blade fire or smoke damper with an improved mechanism for locking the blade of a single blade damper, or a blade of a multiple blade damper with position interlocked blades, in its closed, flow blocking position after the movement of the blade to such position due to a fire or other condition of excessive temperature.

2. Description of the Prior Art

U.S. Pat. No. 3,650,069 (Alley) describes a fire damper with a rotating blade. The rotating blade of the damper of this reference is normally held in an open, flow permitting position by a mechanism which includes a fusible link. The fusible link will fail in the event of a fire or other condition of excessive temperature, whereupon the blade will rotate to its closed, flow blocking position to prevent the passage of smoke through the duct in which the damper is placed. In the fire damper of this reference the blade is latched in its closed position by a latch mechanism which is carried by the blade and which is, therefore, exposed to the full effects of the high temperature condition within the duct. This can lead to warpage or other thermal damage to the latch mechanism, and it partly obstructs fluid flow through the damper when the blade is in its open position.

U.S. Pat. No. 4,338,967 (McCabe) discloses a multiple blade, rotating blade air, smoke or fire damper in which a double link, knee action joint mechanism retains each blade in its closed, flow blocking position. Each knee action joint is in an over center condition when the blade operated thereby is in its closed position. Such over center condition provides some slop in the position of the blade when it is closed, which permits the blade to back off slightly from its fully closed position. This condition can lead to smoke leakage past the blade and vibration or chattering of the blade within the damper. Further, the damper of this reference is motorized, and modern industrial or safety requirements often preclude the use of motorized fire dampers.

SUMMARY OF THE INVENTION

According to the present invention there is provided an improved, non-motorized blade stop and lock mechanism for a rotating blade damper such as a fire damper or a smoke damper. Dampers of this type may be used in ducts or in wall openings. The blade stop and lock mechanism of this invention provides a positive stop for the blade in its open position, and it locks the blade of a single blade damper, or a blade of a multiple blade damper with position interlocked blades, in its closed position. The stop and lock mechanism is located entirely within the damper frame and outside of the air flow path through the annulus that is defined by the frame. Thus, the blade stop and lock mechanism of this invention does not interfere with the flow of air through the damper and the associated duct or wall opening when the blade is in its open position, and it is shielded from direct exposure to the effects of a condition of excessive temperature within the duct or wall opening when such condition leads to a closing of the damper blade. Further, the stop and lock mechanism of this invention does not involve a double linkage, knee action joint which is characteristic of many prior art rotating blade lock or latch mechanisms, such as that of the aforesaid U.S. Pat. No. 4,338,967. Thus, in a damper with a blade lock and stop mechanism according to the present invention, the blade, when closed, is held in its fully closed position, and it is not permitted to back off from such fully closed position as is the case with dampers such as that of the aforesaid U.S. Pat. No. 4,338,967. This is an attribute which substantially prevents smoke leakage past the closed blade and vibration or chattering of the closed blade within the damper.

Accordingly, it is an object of the present invention to provide an improved damper of the rotating blade type for use in a duct in an air handling system or in a wall opening. More particularly, it is an object of the present invention to provide a damper of the rotating blade type with an improved mechanism for stopping and locking a blade of the damper in its closed, flow preventing position in the event of a condition of excessive temperature within the duct which includes such damper or adjacent to a wall having such damper in an opening therein, in the case of a damper incorporating a fusible link, or in response to a signal from a temperature or smoke sensing device near or remote from the damper in the case of a damper incorporating an ETL (electro thermal link) device, a solenoid release or a pressure operated release.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
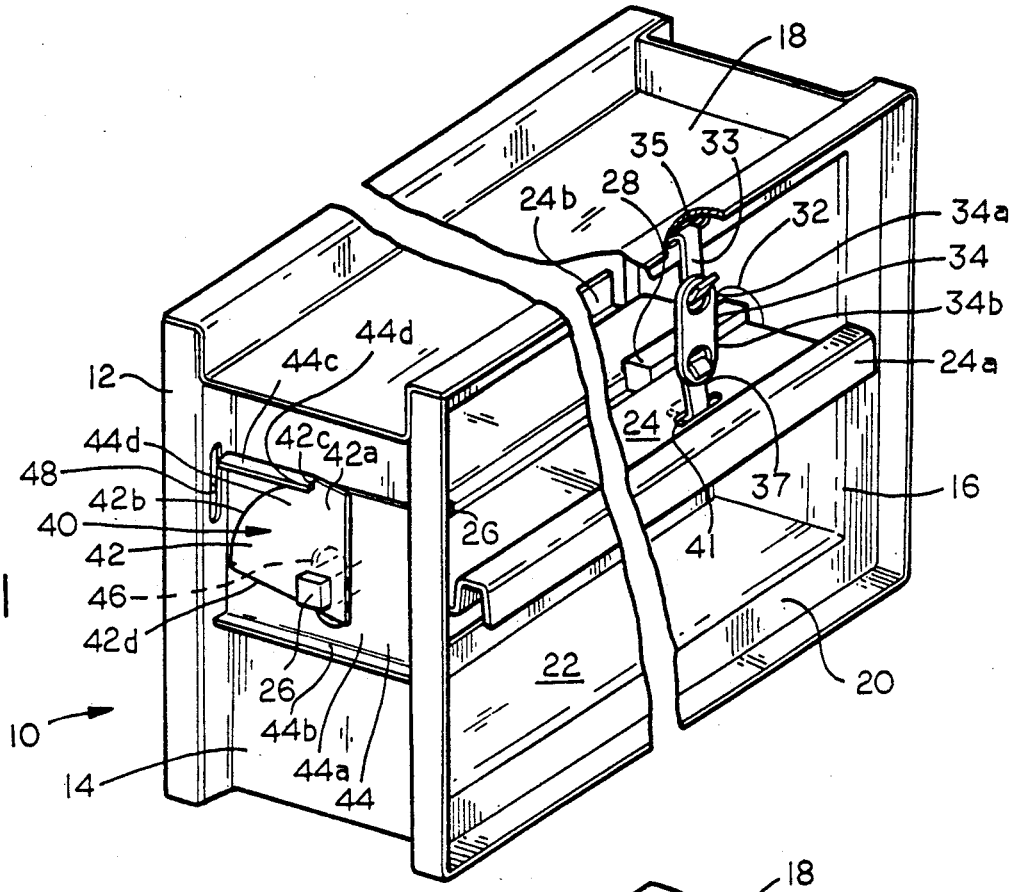
FIG. 1 is a perspective view of a single blade, rotating blade fire damper according to a preferred embodiment of the present invention, the blade of the damper being shown in its open, flow permitting position.
Figure 2:
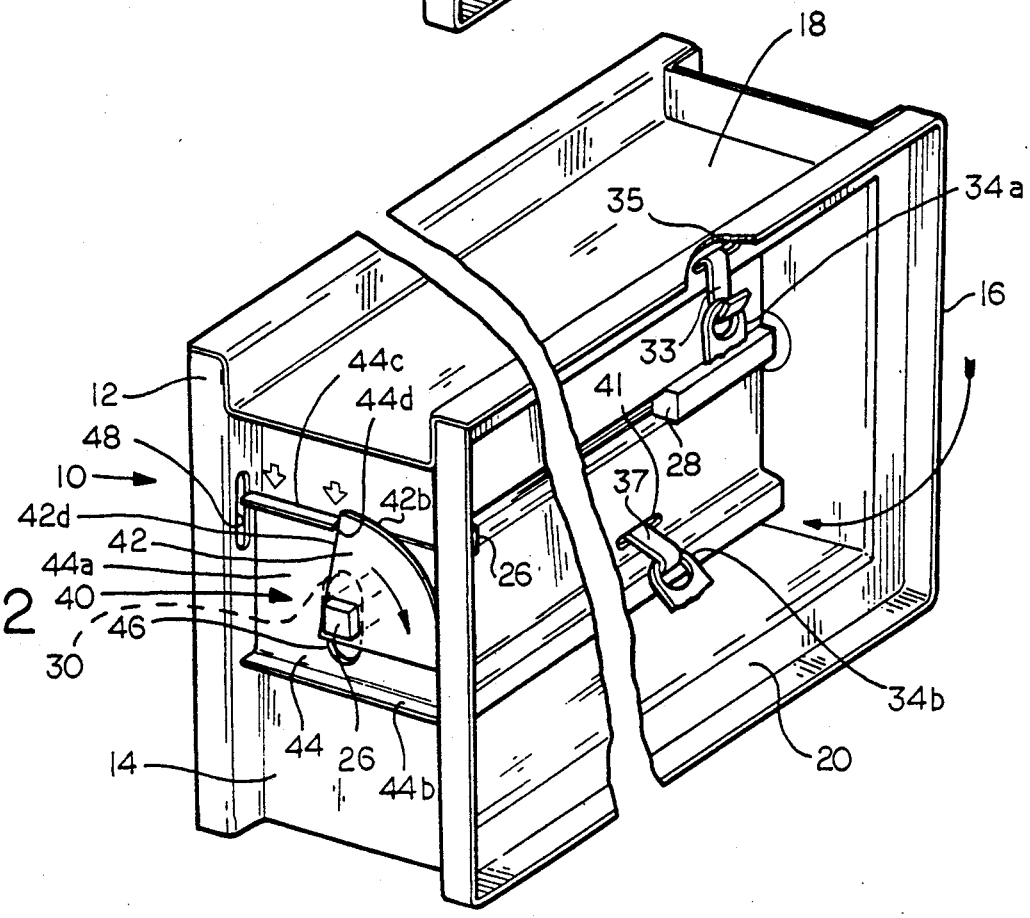
FIG. 2 is a perspective view of the fire damper of FIG. 1 but with the blade being shown in its closed, flow blocking position.
Figure 3:
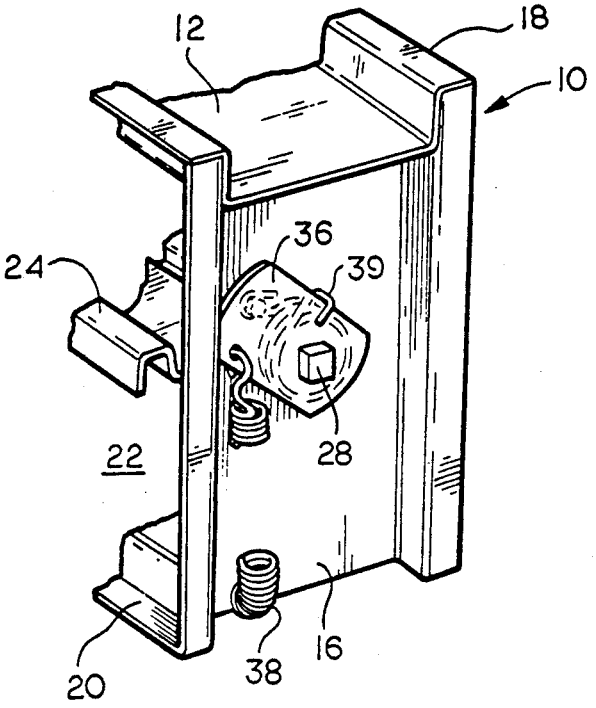
FIG. 3 is a fragmentary perspective view of a portion of the fire damper of FIGS. 1 and 2, in the position of the damper that is shown in FIG. 1.

A single blade, rotating blade fire damper according to the preferred embodiment of the present invention is indicated generally by reference numeral 10 in FIGS. 1–3. The damper 10 comprises a generally rectangular frame 12, which is made up of a pair of spaced apart, side members or jambs 14, 16 and a pair of spaced apart, top and bottom members 18, 20, respectively. The members 14, 16, 18, 20 are joined end-to-end to define a rectangular air flow opening 22 through the interior of the frame 12. The damper 10 is adapted to be positioned within an air flow duct, not shown, so that the opening 22 is in fluid communication with the air flow passage through the duct. Alternatively, the damper 10 is adapted to be positioned within the opening of a wall of an enclosure to control the flow of air into or out of the enclosure.

The damper 10 has a blade 24 positioned within the opening 10, the blade 24 being attached to spaced apart, transversely extending, co-axial rods 26, 28, the opposite ends of which extend through apertures 30, 32 in the side members 14, 16, respectively. The blade 24 is non-rotatably secured to the rods 26, 28, at a location approximately intermediate the opposed leading and trailing edges 24*a*, 24*b*, of the blade, respectively, but is rotatable with the rods 26, 28 relative to the frame 12 between an open, flow permitting position, as shown in FIG. 1, and a closed, flow blocking position, as shown in FIG. 2. Cylindrical members, not shown, are attached to the ends of the rods 26, 28. The cylindrical members are rotatable within the openings 30, 32, respectively, thereby permitting rotation of the blade 24 relative to the frame 12. As is clear from FIG. 2, the outline of the blade 24 substantially fills the opening 22 when the blade 24 is in its FIG. 2 position, other than for normal clearances which are necessary to permit motion between members that must move relative to one another.

As is shown in FIG. 1, the blade 24 is normally held in an open, flow permitting position by temperature sensitive means, such as a fusible link 34, one end, 34*a* of which is secured to an end of a strap 33, which is bent into a generally S shaped configuration in its cross-section. The other end of the strap 33 is secured to a slot 35 of the top member 18 of the frame 12. The other end, 34*b*, of the fusible link 34 is secured to an end of a second strap 37, which is also bent into a generally S shaped configuration in cross-section. The other end of the strap 37 is secured in a slot 41 in the blade 24. The fusible link 34 is constructed from a low melting point metal alloy and will fail if and when it is exposed to a condition of excessive temperature for more than a brief period of time, for example, in the case of a fire within the building where the damper 10 is installed.

Upon the failure of the fusible link 34, the blade 24 will move to its FIG. 2, closed position as hereinafter described, to thereby retard the circulation of smoke or heat from a fire from the location thereof to other parts of the building. The rotation of the blade 24 to its FIG. 2, closed position is accomplished by a spring, alone or in conjunction with gravity. For example, FIG. 3 illustrates a spring operated or spring assisted embodiment in which a link 36 is non-rotatably secured to the end of the rod 28, at a location outside of the side member 16. A double ended coil spring 38 has an end secured to the link 36 and its opposite end secured to the frame 12, illustratively to the bottom member 20. The spring 38 and the link 36 are positioned and connected to apply a turning force on the rod 28 which will rotate the blade 24 to its closed position upon the failure of the fusible link 34. FIG. 3 also illustrates a spiral spring 39 one end of which is restrained by the side member 16 and the other end of which is restrained by the link. The spiral spring 39 also urges the link 36 to the closed position.

While the operation of the damper 10 has been described as being subject to closing in the event of the failure of temperature sensitive means, it also contemplated that it can be made subject to closing under the control of smoke sensitive means such as a solenoid latch or an ETL (electro thermal link) device of the type sold by S&R Products, Inc. of Mendenhall, Pa. The use of a pressure operated damper release, such as Kidde Model 1ND50DC, to release a fire suppressant such as Halon or $CO_2$ is also contemplated as a substitute for the fusible link 34.

The locking of the blade 24 in its FIG. 2 closed position, and the stopping of the blade 24 at a predetermined, FIG. 1, open position, is accomplished by a lock and stop mechanism, which is generally identified by reference numeral 40. The lock and stop mechanism 40 includes a disc segment 42, which is attached to the rod 26 at a location external to the side member 14 and which is rotatable with the rod 26. The lock and stop mechanism 40 further includes a slide plate 44 which is positioned between the side member 14 and the disc segment 42. The slide plate 44 is provided with an internal opening 46 therein, and the internal opening 46, which the end of the rod 26 passes through, is elongate to permit reciprocal movement of the slide plate 44 relative to the disc segment 42 and the rod 26.

The disc segment 42 has a radially outwardly projecting portion 42*a* and an arcuate portion 42*b* which leads away from the outwardly projecting portion 42*a*, which has an arcuate extent of approximately 90 degrees, and which is generally part circular with a center on the axis of rotation of the rod 26. This construction provides a radially extending stop surface 42*c* on the outwardly projecting portion 42*a*, and a second stop surface 42*d* on the back of the disc segment 42, away from the outwardly projecting portion 42*a*. The slide plate 44 has a central web portion 44*a* which extends parallel to the side member 14, a lower flange portion 44*b* which extends outwardly from the web portion 44*a*, and a partial upper flange portion 44*c* which extends outwardly from the web portion 44*a* but only partly thereacross. Thus, the upper flange portion 44*c* has a stop surface 44*d* which engages the stop surface 42*c* when the blade 24 is in its FIG. 1, open position, to ensure that the blade will be precisely positioned in its normal, flow permitting position. At this time the slide plate 44 is in its uppermost position, and is prevented from moving from such position, which could occur due to gravity, vibrations, or otherwise, by engagement between the underside of the upper flange 44*c* of the slide plate 44 and the top surface of the arcuate portion 42*b* of the disc segment 42.

Upon the failure of the fusible link 34, the blade 24 will rotate to separate the stop surface 42*c* from the stop surface 44*d* until such time as the end of the arcuate portion 42*d* clears the stop surface 44*d*. At this time the slide plate 44 will move relative to the rod 26 and the stop surface 44*d* of the slide plate 44 will engage the second stop surface 42*d* on the disc segment to securely lock the blade 24 in its FIG. 2, closed position. The movement of the slide plate 44 from its FIG. 1 position to its FIG. 2 position can be accomplished by gravity when the damper 10 is installed in a vertical orientation. An assist spring, not shown, can be provided to assist in such movement, and will be required if it is desired to install the damper 10 in a horizontal orientation. In the FIG. 2 position of the blade 24 it will not be subject to backing off from a fully closed position as in the case of dampers with double linkage, knee action joint lock mechanisms. Further, desirably the stop surface 42*d* has a slight taper outwardly from the stop surface 44d, which ensures that the forces acting on the slide plate will continuously serve to urge the blade 24 to a fully closed position. In any case, when the condition of excessive temperature which led to the closing of the damper 10 has abated, the damper 10 can be reopened by manually moving the slide plate 44 from its FIG. 2 position to its FIG. 1 position, whereupon the blade 24 can be manually rotated from its FIG. 2 position to its FIG. 1 position and retained in its FIG. 1 position by the installation of a replacement fusible link 34. A slot 48 is provided in the jamb 12 to permit the raising of the slide plate 44 by a tool, not shown, from its FIG. 2 position to its FIG. 1 position, as part of the reopening procedure. This will eliminate the need to remove the damper 10 from its duct or wall opening to permit the raising of the slide plate 44, or the need for providing other, less convenient access to the slide plate 44.

Figure 4:
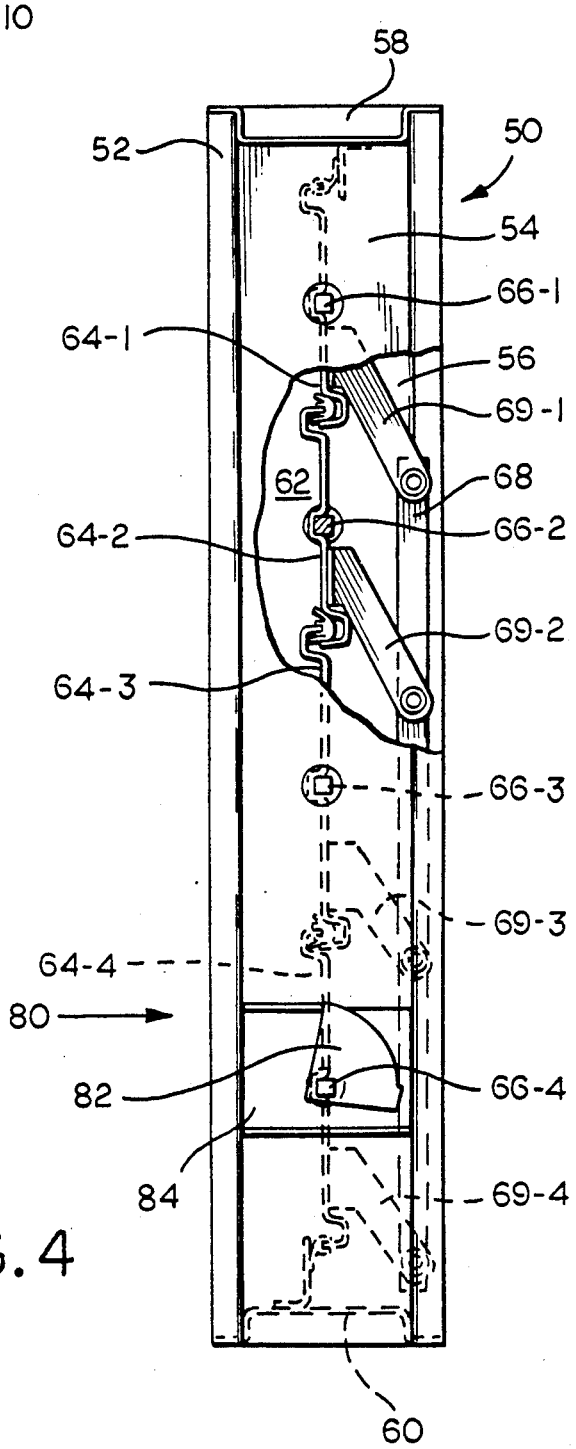
FIG. 4 is an elevational view of a multiple blade, rotating blade fire damper according to a preferred embodiment of the present invention, with a portion of such damper being illustrated fragmentarily for the sake of clarity, the blades of such damper being illustrated in their closed positions.

A multiple blade, rotating blade fire damper according to the preferred embodiment of the present invention is indicated generally by reference numeral 50 in FIG. 4. The damper 50, which is of the face mounted linkage type, comprises a generally rectangular frame 52, which is made up of a pair of spaced apart, side members or jambs 54, 56 and a pair of spaced apart, top and bottom members 58, 60, respectively. The members 54, 56, 58, 60 are joined end-to-end to define a rectangular air flow opening 62 through the interior of the frame 52. The damper 50 is adapted to be positioned within an air flow duct, not shown, so that the opening 62 is in fluid communication with the air flow passage through the duct. Alternatively, the damper 50 is adapted to be positioned within the opening of a wall of an enclosure to control the flow of air into or out of the enclosure.

The damper 50 has a multiplicity of blades positioned within the opening 62, illustratively four (4) of such blades, namely blades 64-1, 64-2, 64-3, and 64-4, respectively, although it is to be understood that a greater or lesser number of such blades can be used. Each of the blades 64-1, 64-2, 64-3, 64-4 is attached to transversely extending rod means 66-1, 66-2, 66-3, 66-4, respectively, each of which extends through apertures, not identified, in the side members 54, 56. Each of the blades 64-1, 64-2, 64-3, 64-4 is non-rotatably secured to its rod means 66-1. 66-2, 66-3, 66-4, respectively, at a location approximately intermediate its leading and trailing edges. Further, each of the blades 64-1, 64-2, 64-3, 64-4 is rotatable with its rod means 66-1, 66-2, 66-3, 66-4, respectively, relative to the frame 52 between a closed, flow blocking position, as shown in FIG. 4, and an open, flow permitting position, not shown, in which each of the blades 64-1 through 64-4 extends at approximately a right angle to its position in FIG. 4. As is shown in FIG. 4, the rod means 66-1 through 66-4 are spaced approximately equidistantly from one another and their axes are substantially parallel and substantially co-planar. However, the rod means 66-1 through 66-4 do not necessarily need to be spaced equidistantly from one another, as blades of different widths and axial spacings can be used in a single, multiple blade damper of the in jamb linkage type to permit standardization on a finite number of damper blade widths.

Figure 5:
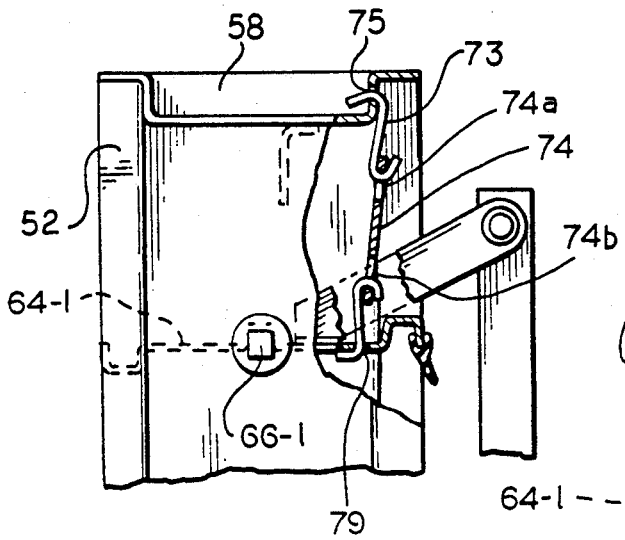
FIG. 5 is a fragmentary view at an enlarged scale of a portion of the fire damper of FIG. 4.

As is shown in FIG. 5, one of the blades 64-1 through 64-4, shown as the blade 64-1, is held in an open, flow permitting position by temperature or smoke sensitive means, for example, by temperature sensitive means such as a fusible link 74, one end of which, 74a, is secured to an end of an S shaped strap 73. The other end of the strap 73 is secured to a slot 75 of the top member 58 of the frame 12. The other end, 74b, of the fusible link 74 is secured to an end of a second S shaped strap 77, and the other end of the strap 77 is secured in a slot 79 in the blade 64-1.

As is clear from FIG. 4, the tips of the blades 64-1 through 64-4 overlap each other in the FIG. 4, closed positions of the blades, and in such positions of the blades 64-1 through 64-4 collectively they substantially fill the opening 62, other than for normal clearances which are necessary to permit motion between members that must move relative to one another. Each of the blades 64-1 through 64-4 is connected to a link bar 68 by a blade bracket 69-1, 69-2, 69-3, 69-4, respectively. Thus, by the reciprocation of the link bar 68 the blades 64-1 through 64-4 are caused to oscillate in unison between their FIG. 4, closed positions and their open positions. The link bar 68 is normally held in a position where each of the blades 64-1 through 64-4 is in its open, flow permitting position by the effect of the fusible link 74 on the blade 64-1, and is resiliently biased to a position where each of the blades 64-1 through 64-4 is in its FIG. 4, closed, flow blocking position by a spring or other resilient means, not shown, or by gravity in a vertical installation of the damper 50.

The locking of each of the blades 64-1 through 64-4 in its FIG. 4 closed position, and the stopping of each of the blades 64-1 through 64-4 at a predetermined, open position, is accomplished by a lock and stop mechanism, which is generally identified by reference numeral 80. The lock and stop mechanism 80 includes a disc segment 82 which is attached to one of the rod means 66-1 through 64-4, shown as the rod means 66-4, at a location external to the side member 54 and which is rotatable with the rod means 66-4. The lock and stop mechanism 80 further includes a slide plate 84 which is positioned between the side member 54 and the disc segment 82. The disc segment 82 and the slide plate 84 correspond in design and function to the disc segment 42 and the slide plate 44, respectively, of the lock and stop mechanism 40 of the embodiment of FIGS. 1-3. Thus, in the event of a fire and the closing of the blades 64-1 through 64-4, the lock and stop mechanism 80 will securely hold each of the blades 64-1 through 64-4 in their closed positions until the damper 50 is manually reopened and reset.

Figure 6:
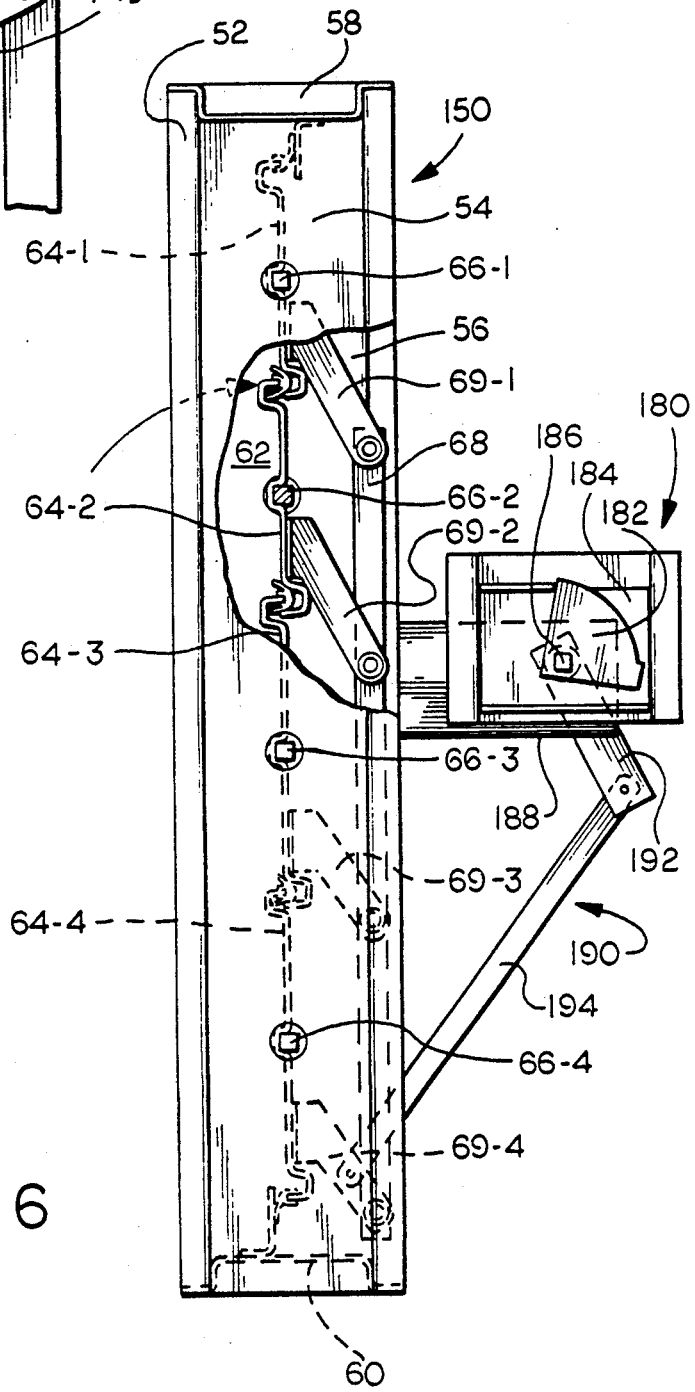
FIG. 6 is a view similar to FIG. 4 illustrating an alternative embodiment of a rotating blade fire damper according to the present invention.

A multiple blade, rotating blade fire damper according to an alternative embodiment of the present invention is indicated generally by reference numeral 150 in FIG. 6. The damper 150 generally corresponds to the damper 50, and to the extent that it does the same numerals are used to identify the elements of the damper 150 which correspond to the elements of the damper 50.

The main difference between the damper 150 and the damper 50 is that the damper 150 incorporates a lock and stop mechanism, which is indicated generally by reference numeral 180, and which is positioned away from the damper 150 rather than at the damper as in the case of the position of the lock and stop mechanism 80 in relation to the damper 50. Thus, the lock and stop mechanism 180 includes a disc segment 182 which is attached to a separate rod 186 rather than to one of the rods 66-1 through 66-4, and a framework extension 188 to the damper 150 is provided to rotatably position the rod 186 away from the vertical plane which extends through the rods 66-1 through 66-4, in the orientation of the damper 150 which is depicted in FIG. 6. The lock and stop mechanism 180 further includes a slide plate 184, which functions in cooperation with the disc segment 182 in the same manner as the slide plate 84 and the disc segment 82 of the embodiment of FIG. 4 function in cooperation with one another, as heretofore described.

The rotation of the rod 186 is translated to the rods 66-1 through 66-4 by linkage means 190. The linkage means 190 includes a first link 192 an end of which is non-rotatably secured to the rod 186 and a second link 194, an end of which is pivotally secured to the other end of the first link 192. In turn, the other end of the second link 194 is attached to one or another of the blade brackets 69-1 through 69-4, shown as the blade bracket 69-4. Thus, when the rod 186 is in a first position, as determined by the relative positions of the disc segment 182 and the slide plate 184, the blades 64-1 through 64-4 of the damper 150 are open to flow, and when the rod 186 is in its second position, again, based on the relative positions of the disc segment 182 and the slide plate 184, the blades 64-1 through 64-4 of the damper 150 are closed to flow. The remote positioning of the lock and stop mechanism 180 relative to the damper 150 is also applicable to a single blade damper of the type illustrated in FIGS. 1–3.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A damper which is adapted to be positioned within a duct or wall opening and which is adapted to define a flow passage with the duct or through the wall opening, said damper comprising:

frame means defining an opening, said frame means having aperture means therein, the flow passage extending through the opening;

blade means, said blade means comprising;

a blade which is positioned in the opening, and rod means extending from said blade through the aperture means in said frame means, said rod means being attached to said blade for rotation in unison therewith;

said blade means being rotatable with respect to said frame means between a first position in which said blade extends generally along the flow passage and a second position in which the blade extends generally transversely of the flow passage;

heat or smoke sensitive means acting on said blade means to normally maintain said blade in the first position, said heat or smoke sensitive means permitting rotation of said blade means from the first position to the second position in the event of a condition of excessive temperature or smoke; and a latch mechanism, said latch mechanism comprising;

a disc segment, said disc segment having an arcuate portion and a generally radially extending stop surface at an end of the arcuate portion, said disc segment being rotatable with said rod means, and a slide plate, said slide plate having an elongate slot therein, said slide plate being slidable with respect to said rod means between a first position in which said blade means is in said first position and a second position in which said blade means is in said second position, said slide plate having a stop surface which engages said stop surface of said disc segment to prevent the return rotation of said blade means from said second position to said first position.

2. A damper according to claim 1 and further comprising:

biasing means acting on said blade means to cause rotation of said blade means from said first position to said second position.

3. A damper according to claim 1 wherein said slide plate comprises;

a web portion, said web portion extending transversely of said rod means along a path of movement of said slide plate, and a flange portion, said flange portion extending normally from said web portion, said stop surface being a surface of said flange portion.

4. A damper according to claim 3 wherein said flange portion of said slide plate engages said arcuate portion of said disc segment when said blade means is in its first position and said slide plate is in its first position, to thereby prevent said slide plate from moving to its second position until said blade means rotates to its second position.

5. A damper according to claim 3 wherein said disc segment further has a radially outwardly projecting portion projecting outwardly past the arcuate portion at an end of the arcuate portion away from the generally radially extending stop surface, said radially outwardly projecting portion having a second stop surface, said second stop surface of said disc segment engaging said stop surface of said slide plate when said blade means is in said first position.

6. A damper according to claim 4 wherein said disc segment further has a radially outwardly projecting portion projecting outwardly past the arcuate portion at an end of the arcuate portion away from the generally radially extending stop surface, said radially outwardly projecting portion having a second stop surface, said second stop surface of said disc segment engaging said stop surface of said slide plate when said blade means is in said first position.

7. A damper according to claim 1 wherein said disc segment is attached to said rod means at a location on said rod means which is external to the opening defined by said frame means for rotation with said rod means, wherein said slide plate is positioned between said disc segment and said frame means, and wherein said rod means extends through said elongate slot of said slide plate.

8. A damper according to claim 1 wherein said blade substantially fills the opening when said blade means is in its second position.

9. A damper according to claim 1 wherein said damper is non-motorized.

10. A damper according to claim 1 wherein said heat or smoke sensitive means is a heat sensitive means.

11. A damper according to claim 10 wherein said heat sensitive means comprises a fusible link.

12. A damper which is adapted to be positioned within a duct or wall opening and which is adapted to define a flow passage with the duct or wall opening, said damper comprising:

frame means defining a generally rectangular opening, the flow passage extending through the opening, said frame means comprising;

a first pair of opposed frame members, said first pair of opposed frame members being spaced from one another and extending generally parallel to one another, one of said first pair of opposed frame members having an aperture therein, and a second pair of opposed frame members, said second pair of opposed frame members being spaced from one another and extending generally parallel to one another and transversely of said first pair of opposed frame members;

blade means, said blade means comprising;

a blade which is positioned in the opening, and rod means extending from said blade through the aperture in said one of said first pair of opposed frame members, said rod means being attached to said blade for rotation in unison therewith;

said blade means being rotatable with respect to said frame means between a first position in which said blade extends generally along the flow passage and a second position in which the blade extends generally transversely of the flow passage;

heat or smoke sensitive means acting on said blade means to normally maintain said blade in the first position, said heat or smoke sensitive means permitting rotation of said blade means from the first position to the second position in the event of a condition of excessive temperature or smoke; and a latch mechanism, said latch mechanism comprising;

a disc segment, said disc segment having an arcuate portion and a generally radially extending stop surface at an end of the arcuate portion, said disc segment being rotatable with said rod means, a slide plate, said slide plate having an elongate slot therein, said slide plate being slidable with respect to said rod means in a direction extending generally parallel to the one of said first pair of opposed frame members between a first position in which said blade means is in said first position and a second position in which said blade means is in said second position, said slide plate having a stop surface which engages said stop surface of said disc segment to prevent the return rotation of said blade means from said second position to said first position.

13. A damper according to claim 12 and further comprising:

biasing means acting on said blade means to cause rotation of said blade means from said first position to said second position.

14. A damper according to claim 12 wherein said slide plate comprises:

a web portion, said web portion extending transversely of said rod means and generally parallel to the one of said first pair of opposed frame members along a path of movement of said side plate, and a flange portion, said flange portion extending normally from said web portion, said stop surface being a surface of said flange portion.

15. A damper according to claim 14 wherein said flange portion of said slide plate engages said arcuate portion of said disc segment when said blade means is in its first position and said slide plate is in its first position, to thereby prevent said slide plate from moving to its second position until said blade means rotates to its second position.

16. A damper according to claim 14 wherein said disc segment further has a radially outwardly projecting portion projecting outwardly past the arcuate portion at an end of the arcuate portion away from the generally radially extending stop surface, said radially outwardly projecting portion having a second stop surface, said second stop surface of said disc segment engaging said stop surface of said slide plate when said blade means is in said first position.

17. A damper according to claim 15 wherein said disc segment further has a radially outwardly projecting portion projecting outwardly past the arcuate portion at an end of the arcuate portion away from the generally radially extending stop surface, said radially outwardly projecting portion having a second stop surface, said second stop surface of said disc segment engaging said stop surface of said slide plate when said blade means is in said first position.

18. A damper according to claim 12 wherein said disc segment is attached to said rod means at a location on said rod means which is external to the opening defined by said frame means for rotation with said rod means, wherein said slide plate is positioned between said disc segment and said one of said first pair of opposed frame members, and wherein said rod means extends through said elongate slot of said slide plate.

19. A damper according to claim 12 wherein said blade substantially fills the opening when said blade means is in its second position.

20. A damper according to claim 12 wherein the other of said first pair of opposed frame members has a second aperture therein, said aperture and said second aperture being coaxial, and wherein said rod means further extends from said blade through said second aperture.

21. A damper according to claim 20 wherein said rod means comprises first and second rods, said first and second rods being coaxial and being spaced apart along the axes thereof.

22. A damper according to claim 13 wherein the other of said first pair of opposed frame members has a second aperture therein, said aperture and said second aperture being coaxial, and wherein said rod means further extends from said blade through said second aperture.

23. A damper according to claim 22 wherein said rod means comprises first and second rods, said first and second rods being coaxial and being spaced apart along the axes thereof.

24. A damper according to claim 23 wherein said disc segment is attached to one of said first and second rods, and wherein said biasing means act on the other of said first and second rods.

25. A damper according to claim 24 wherein said biasing means comprises:

a link, said link being attached to said other of said first and second rods; and spring means having a first end attached to said frame means and a second end attached to said link, said spring means normally urging said link to move said blade means to said second position.

26. A damper according to claim 12 wherein said damper is non-motorized.

27. A damper according to claim 12 wherein said heat or smoke sensitive means is a heat sensitive means.

28. A damper according to claim 27 wherein said heat sensitive means is a fusible link.

29. A damper which is adapted to be positioned within a duct or wall opening and which is adapted to define a flow passage with the duct or wall opening, said damper comprising:

frame means defining a generally rectangular opening, the flow passage extending through the opening, said frame means comprising;

a first pair of opposed frame members, said first pair of opposed frame members being spaced from one another and extending generally parallel to one another, and a second pair of opposed frame members, said second pair of opposed frame members being spaced from one another and extending generally parallel to one another and transversely of said first pair of opposed frame members;

a plurality of blade means, each of said blade means comprising;

a blade which is positioned in the opening, and rod means extending from said blade through one of said first pair of opposed frame members, said rod means being attached to said blade for rotation in unison therewith;

each of said plurality of blade means being rotatable with respect to said frame means between a first position in which the blade of said each of said plurality of blade means extends generally along the flow passage and a second position in which the blade of said each of said plurality of blade means extends generally transversely of the flow passage;

heat or smoke sensitive means acting on said plurality of blade means to normally maintain the blades of said plurality of blade means in the first position, said heat sensitive means permitting rotation of the blades of said plurality of blade means from the first position to the second position in the event of a condition of excessive temperature or smoke; and a latch mechanism, said latch mechanism comprising;

a disc segment, said disc segment having an arcuate portion and a generally radially extending stop surface at an end of the arcuate portion, said disc segment being rotatable with one of said plurality of blade means, and a slide plate, said slide plate having an elongate slot therein, said slide plate being slidable with respect to the rod means of said one of said plurality of blade means in a direction extending generally parallel to the one of said first pair of opposed frame members between a first position in which said one of said plurality of blade means is in said first position and a second position in which said one of said plurality of blade means is in said second position, said slide plate having a stop surface which engages said stop surface of said disc segment to prevent the return rotation of said blade means from said second position to said first position.

30. A damper according to claim 29 and further comprising:

linkage means interconnecting each of said plurality of blade means for rotation in unison between the first position of the blade of each of said plurality of blade means and the second position of the blade of each of said plurality of blade means.

31. A damper according to claim 29 wherein said slide plate comprises;

a web portion, said web portion extending transversely of said rod means and generally parallel to the one of said first pair of opposed frame members along a path of movement of said side plate, and a flange portion, said flange portion extending normally from said web portion, said stop surface being a surface of said flange portion.

32. A damper according to claim 30 wherein said slide plate comprises;

a web portion, said web portion extending transversely of said rod means and generally parallel to the one of said first pair of opposed frame members along a path of movement of said side plate, and a flange portion, said flange portion extending normally from said web portion, said stop surface being a surface of said flange portion.

33. A damper according to claim 31 wherein said flange portion of said slide plate engages said arcuate portion of said disc segment when said blade means is in its first position and said slide plate is in its first position, to thereby prevent said slide plate from moving to its second position until said blade means rotates to its second position.

34. A damper according to claim 30 wherein said disc segment further has a radially outwardly projecting portion projecting outwardly past the arcuate portion at an end of the arcuate portion away from the generally radially extending stop surface, said radially outwardly projecting portion having a second stop surface, said second stop surface of said disc segment engaging said stop surface of said slide plate when each of said plurality of blade means is in said first position.

35. A damper according to claim 32 wherein said disc segment further has a radially outwardly projecting portion projecting outwardly past the arcuate portion at an end of the arcuate portion away from the generally radially extending stop surface, said radially outwardly projecting portion having a second stop surface, said second stop surface of said disc segment engaging said stop surface of said slide plate when each of said plurality of blade means is in said first position.

36. A damper according to claim 31 wherein said disc segment is attached to the rod means of said one of said plurality of blade means at a location on said rod means which is external to the opening defined by said frame means for rotation with said the rod means, wherein said slide plate is positioned between said disc segment and said one of said first pair of opposed frame members, and wherein said the rod means extends through said elongate slot of said slide plate.

37. A damper according to claim 30 wherein the blades of said plurality of blade means substantially fill the opening when said plurality of blade means are in said second position.

38. A damper according to claim 29 wherein said damper is non-motorized.

39. A damper according to claim 29 wherein said heat or smoke sensitive means is a heat sensitive means.

40. A damper according to claim 39 wherein said heat sensitive means is a fusible link.

41. A damper according to claim 29 wherein said heat or smoke sensitive means acts on one of said plurality of blade means, and further comprising:

interconnecting means interconnecting each of the other of said plurality of blade means with said one of said plurality of blade means for rotation therewith.

42. A damper according to claim 29 and further comprising:

second rod means;

means rotatably positioning said second rod means away from said rod means;

said disc segment being affixed to said second rod means and being rotatable therewith;

said second rod means extending through said elongate slot in said slide plate; and linkage means linking said second rod means to said plurality of blade means.

* * * * *